US011330839B2

(12) United States Patent
Oliveria

(10) Patent No.: US 11,330,839 B2
(45) Date of Patent: May 17, 2022

(54) BOTTLE SMOKING DEVICE CONVERSION KIT

(71) Applicant: Christopher Oliveria, Scappoose, OR (US)

(72) Inventor: Christopher Oliveria, Scappoose, OR (US)

( * ) Notice: Subject to any disclaimer, the term of this patent is extended or adjusted under 35 U.S.C. 154(b) by 40 days.

(21) Appl. No.: 15/931,688

(22) Filed: May 14, 2020

(65) Prior Publication Data

US 2020/0359679 A1 Nov. 19, 2020

Related U.S. Application Data

(60) Provisional application No. 62/847,647, filed on May 14, 2019.

(51) Int. Cl.

| | |
|---|---|
| ***A24F 13/12*** | (2006.01) |
| ***A24F 7/02*** | (2006.01) |
| ***A24F 13/22*** | (2006.01) |
| ***B26F 1/32*** | (2006.01) |
| *A24F 9/00* | (2006.01) |

(52) U.S. Cl.

CPC ..... *A24F 13/12* (2013.01); *A24F 7/02* (2013.01); *B26F 1/32* (2013.01); *A24F 9/00* (2013.01); *A24F 13/22* (2013.01)

(58) Field of Classification Search

CPC ..... A24F 1/30; A24F 1/28; A24F 1/32; A24F 3/00; A24F 9/00

See application file for complete search history.

(56) References Cited

U.S. PATENT DOCUMENTS

| | | | | |
|---|---|---|---|---|
| 1,507,571 | A * | 9/1924 | Barling | A24F 7/00 131/229 |
| 4,236,539 | A * | 12/1980 | Mosby, Jr. | A24F 13/16 131/175 |
| 5,020,690 | A * | 6/1991 | Kishikawa | B65D 5/748 222/541.2 |
| 5,803,310 | A * | 9/1998 | Soon | B67B 7/26 222/1 |
| 2013/0146070 | A1* | 6/2013 | Ross | A24F 1/30 131/173 |
| 2014/0182606 | A1 | 7/2014 | Lotringer | |
| 2014/0326256 | A1 | 11/2014 | McKay | |
| 2015/0173418 | A1* | 6/2015 | McArthur | B26F 1/32 131/226 |
| 2016/0270439 | A1 | 9/2016 | Webber | |
| 2016/0302480 | A1 | 10/2016 | Rhoades | |

* cited by examiner

*Primary Examiner* — Michael H. Wilson
*Assistant Examiner* — Stephanie Lynn Moore
(74) *Attorney, Agent, or Firm* — Boudwin Intellectual Property; Daniel Boudwin

(57) ABSTRACT

A bottle smoking device conversion kit is provided. The bottle smoking device conversion kit includes a body having a protrusion extending from an upper side thereof. A recess is disposed in a lower side of the body, wherein the recess is dimensioned to secure a smokable item therein. The protrusion removably secures within an annular mouthpiece. A channel extends through the body and the protrusion. A blade is disposed on a distal end of the protrusion, wherein the blade is disposed about the channel.

20 Claims, 2 Drawing Sheets

BOTTLE SMOKING DEVICE CONVERSION KIT

CROSS REFERENCE TO RELATED APPLICATIONS

This application claims the benefit of U.S. Provisional Application No. 62/847,647 filed on May 14, 2019. The above identified patent application is herein incorporated by reference in its entirety to provide continuity of disclosure.

BACKGROUND OF THE INVENTION

The present invention relates to bottle smoking devices. More particularly, the present invention pertains to a kit for converting an existing bottle into a smoking device.

Many individuals enjoy smoking, however holding a cigarette or other object in their mouth may be undesirable. Often, saliva seeps into the cigarette which can result in an unpleasantly damp sensation when smoking. Additionally, saliva accumulation within the cigarette may disrupt the flow of smoke through the cigarette, which can result in wasted smoking material. Furthermore, saliva can dampen the smoking material potentially preventing proper ignition thereof. Individuals may also desire to share cigarettes, however doing so may be undesirable due to hygiene concerns. Saliva build up within a cigarette can be a possible vector of contamination, increasing the risk of communicating an illness to another. Therefore, a device that can provide a sanitary and pleasant smoking experience using readily available household items is desired.

In light of the devices disclosed in the known art, it is submitted that the present invention substantially diverges in design elements from the known art and consequently it is clear that there is a need in the art for an improvement to existing bottle smoking device conversion kits. In this regard, the instant invention substantially fulfills these needs.

SUMMARY OF THE INVENTION

In view of the foregoing disadvantages inherent in the known types of bottle smoking devices now present in the known art, the present invention provides a bottle smoking device conversion kit wherein the same can be utilized for providing convenience for the user when converting an existing bottle into a bottle smoking device.

The present system comprises a body having a protrusion extending from an upper side thereof. A recess is disposed on a lower side of the body, wherein the recess is dimensioned to secure a smokable item therein. The protrusion is configured to removably secure within an annular mouthpiece via frictional engagement. In some embodiments, the mouthpiece is configured to removably secure to the protrusion via threading disposed on an exterior surface thereof. A channel extends through the body and the protrusion. A blade is disposed on a distal end of the protrusion, wherein the blade is disposed about the channel. The blade can be used to cut an aperture within a cap of an existing bottle, such that the protrusion can extend therethrough. In this manner, the user can secure the cap to the body between the body and the mouthpiece, allowing the body to be secured within the bottle. In this manner, a bottle can be converted into a smoking apparatus to prevent the accumulation of saliva within the smokable item, thereby increasing hygiene and user comfort during use.

In some embodiments, the recess is coaxial with the channel, such that the flow of aft through the recess and channel is optimized. In another embodiment, the diameter of the recess is greater than a diameter of the channel, such that a user can secure a smokable item with a larger diameter, such as a cigar, within the recess. In other embodiments, the bade comprises a cylindrical blade disposed coaxially with the channel. In yet another embodiment, the blade is disposed on an interior edge of the distal end of the protrusion. In this manner, the bade comprises a smaller diameter than that of the protrusion, ensuring a seal is formed between the protrusion and an aperture cut by the blade, thereby preventing leakage horn an interior of the bottle. In some embodiments, a working end of the blade tapers to a cutting edge along an entirety thereof. In another embodiment, a first end of the mouthpiece comprises a flange extending therefrom. In other embodiments, the mouthpiece comprises at least one concavity on an exterior surface thereof, the concavity configured to conform to a mouth of a user.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
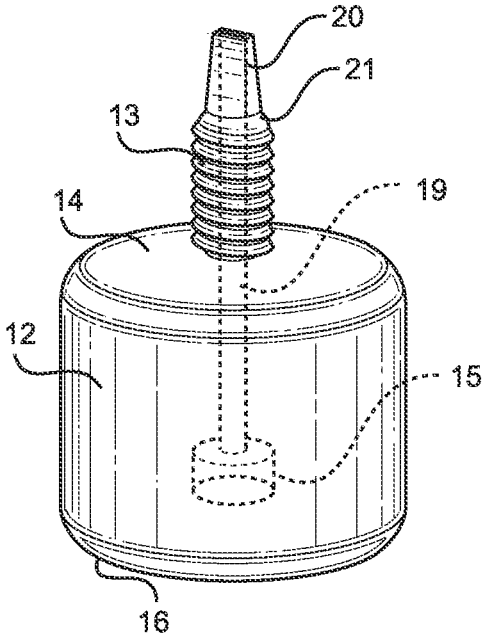
FIG. 1A shows a perspective view of the body of an embodiment of the bottle smoking device conversion kit.

Reference is made herein to the attached drawings. Like reference numerals are used throughout the drawings to depict like or similar elements of the bottle smoking device conversion kit. The figures are intended for representative purposes only and should not be considered to be limiting in any respect.

Figure 1B:
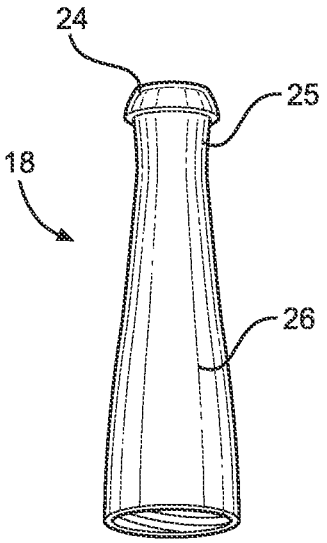
FIG. 1B shows a perspective view of the mouthpiece of an embodiment of the bottle smoking device conversion kit.
Figure 3:
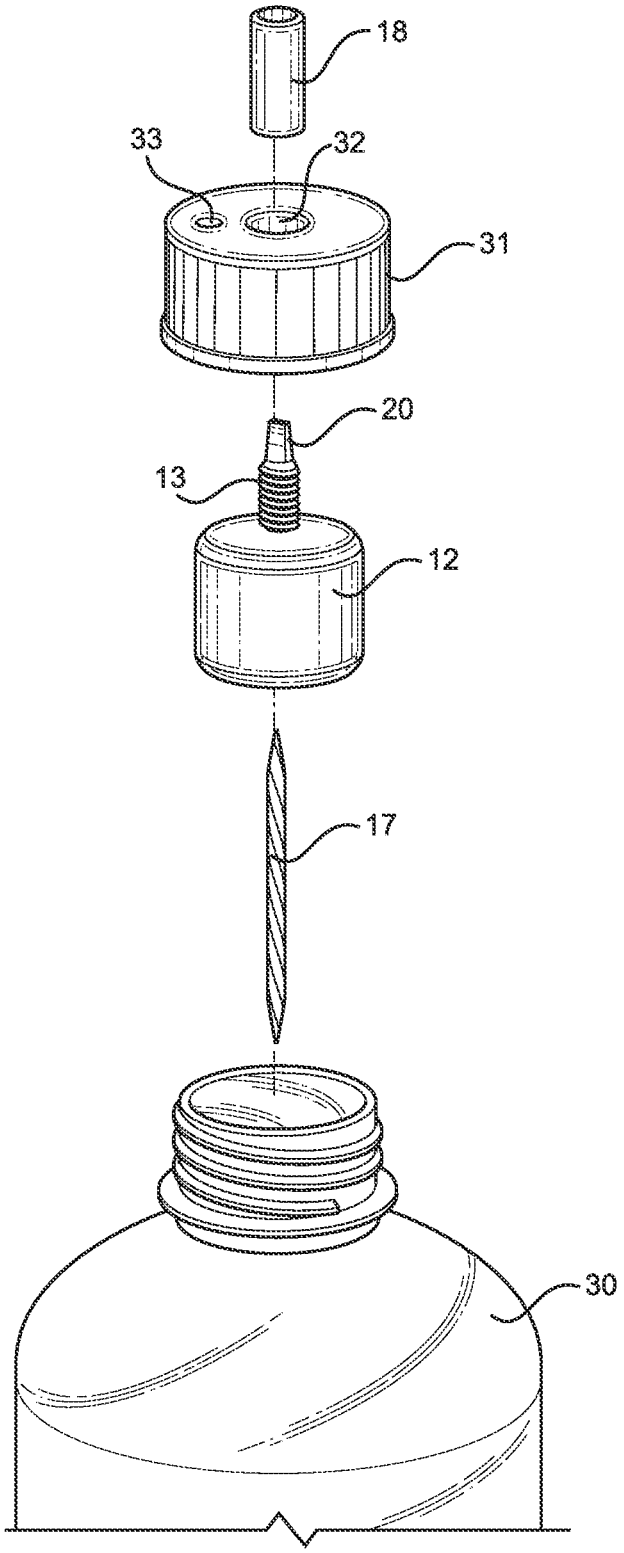
FIG. 3 shows an exploded view of an embodiment of the bottle smoking device conversion kit in combination with a bottle.

Referring now to FIGS. 1A and 1B, there is shown a perspective view of the body of an embodiment of the bottle smoking device conversion kit and a perspective view of the mouthpiece of an embodiment of the bottle smoking device conversion kit, respectively. The bottle smoking device conversion kit comprises a body 12 having a protrusion 13 extending from an upper side 14 thereof. The body 12 is dimensioned to secure through a neck of an existing, bottle (as shown in FIG. 3, 30), such that the body 12 can be supported therein. A channel 19 extends through the body 12 and the protrusion 13, wherein the channel 19 is configured to allow air and smoke to flow therethrough. In the shown embodiment, the body 12 further comprises a recess 15 disposed in a lower side 16 thereof, wherein the recess 15 is dimensioned to removably secure a smokable item (as shown in FIG. 3, 17) therein, such that the smokable item is aligned with the channel 19. In this manner, the flow of air through the channel 19 facilitates the generation of smoke via the smokable item, allowing a user to inhale the smoke without directly contacting the smokable item with their mouth or fingers.

The protrusion 13 further comprises a annular blade 20 disposed on a distal end 21 thereof, such that the blade 20 is disposed about the channel 19. This produces a hollow blade 20 allowing smoke generated by the smokable item to pass therethrough. The blade 20 enables a user to puncture an aperture through a cap of a bottle, such that the protrusion 13 can extend through the aperture. In the shown embodiment, the blade 20 tapers inwardly from a lower end thereof towards an upper end thereof, such that a cutting edge is defined along an entirety of the blade 20. Due to the likelihood of impact and exposure to smoke, the blade 20 is contemplated to comprise a variety of durable and corrosion resistant materials, such as, but not limited to carbon steel, stainless steel, titanium, ceramic, or the like.

The bottle smoking device conversion kit further comprises an annular mouthpiece 18 removably securable to the body 12 via the protrusion 13. The annular nature of the mouthpiece 18 ensures that the flow of air through the channel 19 can continue through the mouthpiece 18, allowing a user to inhale therethrough. In the illustrated embodiment of FIG. 1B, the mouthpiece 18 further comprises a flange 24 extending from a first end 25 thereof, wherein the flange 24 is configured to stabilize the mouthpiece 18 within a user's mouth. The flange 24 further serves to anchor the mouthpiece 18 behind a user's lips or teeth, ensuring that the mouthpiece 18 does not become accidentally dislodged therefrom, in the illustrated embodiment, the flange 24 further comprises a rounded upper edge, so as to provide comfort to the user. In some embodiments, the mouthpiece 18 further comprises at least one concavity 26 therein, wherein the concavity 26 allows the mouthpiece 18 to conform to the user's mouth to maximize comfort during use. In the illustrated embodiment, the concavity 26 extends around an entire circumference of the mouthpiece 18, whereas, in alternate embodiments, a pair of concavities 26 are disposed on opposing sides of the mouthpiece 18 to conform to an upper lip and a lower lip of the user, respectively. The mouthpiece 18 is contemplated to comprise a nonporous and easily cleaned material to prevent the accumulation of saliva, ash, soot, and the like therein, such that the user is provided with a pleasant smoking experience. Furthermore, this ensures maximum hygiene if the user desires to share the smokable item with additional users.

Figure 2:
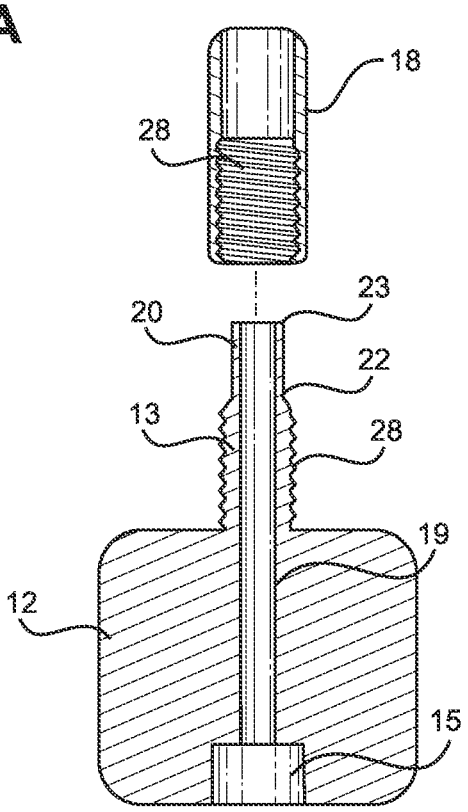
FIG. 2 shows a cross-sectional exploded view of an embodiment of the bottle smoking device conversion kit.

Referring now to FIG. 2, there is shown a cross-sectional exploded view of an embodiment of the bottle smoking device conversion kit. In the shown embodiment, the channel 19 is coaxially aligned with each of the protrusion 13 and the recess 15, ensuring direct flow of smoke generated by the smokable item therethrough. In this manner, the smoke is transferred as efficiently as possible, allowing the user to minimize wasted smoking material. In the illustrated embodiment, the recess 15 further comprises a larger diameter than that of the channel 19, such that larger smokable items can be secured therein, such as cigars, via frictional engagement. However, it is contemplated that in alternate embodiments, the recess 15 and the channel 19 comprise the same diameter.

In the shown embodiment, the protrusion 13 further comprises threading 28 disposed along an exterior surface thereof, wherein the threading 28 is configured to engage complementary threading 28 disposed on an interior surface of the mouthpiece 18. In this manner, the mouthpiece 18 can be securely affixed to the body 12. In some embodiments, the threading 28 forms an air-tight seal when the mouthpiece 18 is affixed to the protrusion 13, such that smoke does not seep through the connection between the protrusion 13 and the mouthpiece 18. In alternate embodiments, the mouthpiece 18 removably secures to the protrusion 13 via frictional engagement therewith, such that the complexity of manufacture is minimized.

In the shown embodiment, a cutting edge of the blade 20 is defined along an entirety of a working end 23 thereof to ensure that an aperture can be easily created through the cap of a bottle. The blade 20 is further disposed on an interior edge 22 of the protrusion 13, such that the blade 20 defines a smaller diameter than the protrusion 13. In this manner, the aperture created by the blade 20 is smaller than the protrusion 13 ensuring a seal is formed therebetween when the protrusion 13 is placed through the aperture. Additionally, the smaller diameter of the blade 20 ensures that the mouthpiece 18 can be readily secured to the protrusion 13 with minimal contact to the blade 20. In this manner, impact to the blade 20 when affixing the mouthpiece 18 is minimized, such that dulling of the working end 23 is prevented. In some embodiments, the height of the blade 20 varies along the working end 23 defining a point on the blade 20, such that the force required to initially puncture a cap of a bottle is reduced.

Referring now to FIG. 3, there is shown an exploded view of an embodiment of the bottle smoking device conversion kit in combination with a bottle. In one use, the cap 31, of an existing bottle 30 is removed therefrom. The blade 20 is placed against the cap 31 to cut an aperture 32 therethrough. In some cases, a plug formed from the portion of the cap 31 removed to create the aperture 32 must then be dislodged from within the blade 20, such that air can flow therethrough. In some uses, a ventilation aperture 33 is then cut through the cap 31 adjacent to the aperture 32, wherein the ventilation aperture 33 is configured to allow air to flow into the bottle 30 to ventilate the smokable item 17 to ensure it continues burning. The protrusion 13 of the body 12 is then placed through the aperture 32 and the mouthpiece 18 is secured to the protrusion 13, in this manner, the body 12 is affixed to the cap 31, allowing the body 12 to be suspended within the bottle 30 when the cap 31 is secured thereto. The smokable item 17 is then secured within the recess of the body 12 and ignited. The user can then secure the cap 31 to the bottle 30, and the user can inhale through the mouthpiece 18 to draw smoke therethrough. To ensure the smokable item 17 continues to burn at a desired level, the user can squeeze the bottle 30 to draw air through the ventilation aperture 33 as the bottle 30 is released. In this manner, the user can easily smoke a smokable item 17 without wasting smokable material due to saliva absorption, while also increasing the hygiene of group smoking. Additionally, the bottle 30 serves to trap smoke therein, such that the surrounding area is minimally impacted thereby, while also preserving smoke that would otherwise be wasted.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bottle smoking device conversion kit, comprising:

a unitary body having an integral protrusion extending substantially orthogonally from an upper side of the body;

a recess disposed in a lower side of the body, wherein the recess is dimensioned to receive a smokable item therein;

wherein the protrusion is configured to removably secure within an annular mouthpiece;

wherein a channel extends through the body and the protrusion;

an annular blade disposed on a distal end of the protrusion, wherein the blade is disposed about the channel.

2. The bottle smoking device conversion kit of claim 1, wherein the recess is coaxial with the channel.

3. The bottle smoking device conversion kit of claim 1, wherein the blade comprises a cylindrical blade disposed coaxially with the channel.

4. The bottle smoking device conversion kit of claim 1, wherein the blade is disposed on an interior edge of the distal end, such that an outer diameter of the blade is less than an outer diameter of the protrusion.

5. The bottle smoking device conversion kit of claim 1, wherein a diameter of the recess is greater than a diameter of the channel.

6. The bottle smoking device conversion kit of claim 1, wherein a working end of the blade tapers to a cutting edge along an entirety thereof.

7. The bottle smoking device conversion kit of claim 1, wherein a first end of the mouthpiece comprises a flange extending therefrom.

8. The bottle smoking device conversion kit of claim 1, wherein the mouthpiece comprises at least one concavity configured to conform to a mouth of a user.

9. A bottle smoking device conversion kit, comprising:

a unitary body having an integral protrusion extending substantially orthogonally from an upper side of the body;

a recess disposed in a lower side of the body, wherein the recess is dimensioned to receive a smokable item therein;

wherein the protrusion is configured to removably secure within an annular mouthpiece;

wherein an exterior surface of the protrusion comprises threading thereon, the threading configured to engage complementary threading disposed on an interior surface of the mouthpiece;

wherein a channel extends through the body and the protrusion;

a blade disposed on a distal end of the protrusion, wherein the blade is disposed about the channel.

10. The bottle smoking device conversion kit of claim 9, wherein the recess is coaxial with the channel.

11. The bottle smoking device conversion kit of claim 9, wherein the blade comprises a cylindrical blade disposed coaxially with the channel.

12. The bottle smoking device conversion kit of claim 9, wherein the blade is disposed on an interior edge of the distal end, such that an outer diameter of the blade is less than an outer diameter of the protrusion.

13. The bottle smoking device conversion kit of claim 9, wherein a diameter of the recess is greater than a diameter of the channel.

14. The bottle smoking device conversion kit of claim 9, wherein a working end of the blade tapers to a cutting edge along an entirety thereof.

15. The bottle smoking device conversion kit of claim 9, wherein a first end of the mouthpiece comprises a flange extending therefrom.

16. The bottle smoking device conversion kit of claim 9, wherein the mouthpiece comprises at least one concavity configured to conform to a mouth of a user.

17. A method for using a bottle smoking device conversion kit, comprising:

providing a unitary body having an integral protrusion extending substantially orthogonally from an upper side of the body, wherein a cylindrical blade is disposed on a distal end of the protrusion;

wherein a channel extends through the body and the protrusion;

removing a cap from a bottle;

cutting an aperture through the cap with the blade;

inserting the protrusion through the aperture;

securing a mouthpiece over the protrusion, such that the cap is secured therebetween;

inserting a smokable item within a recess disposed in a lower side of the body;

igniting the smokable item;

securing the cap on a bottle such that the body is disposed within an interior volume of the bottle;

inhaling through the mouthpiece.

18. The method of claim 17, further comprising removing a plug formed within the blade after cutting the aperture.

19. The method of claim 17, further comprising cutting a ventilation aperture through the cap adjacent to the aperture.

20. The method of claim 17, further comprising compressing the bottle to ventilate the smokable item.

* * * * *